United States Patent [19]

Vanasse

[11] 4,331,240

[45] May 25, 1982

[54] STAPLE STICK PACKAGE

[75] Inventor: Raymond A. Vanasse, West Warwick, R.I.

[73] Assignee: Textron Inc., Providence, R.I.

[21] Appl. No.: 159,651

[22] Filed: Jun. 16, 1980

[51] Int. Cl.[3] ..... B65D 5/54

[52] U.S. Cl. ..... 206/621; 206/491; 206/626; 206/806; 206/340; 229/33; 229/45 R

[58] Field of Search ..... 206/340, 491, 491.1, 206/621, 626, 806; 229/33, 45

[56] References Cited

U.S. PATENT DOCUMENTS

| | | | |
|---|---|---|---|
| 2,354,083 | 7/1944 | Bixby | 206/340 |
| 2,713,963 | 7/1955 | Andrews et al. | 229/33 |
| 2,839,236 | 6/1958 | Dunning | 229/45 |
| 3,066,843 | 12/1962 | Johnson | 206/491 |
| 3,556,292 | 1/1971 | Krzyzanowski | 206/621 |
| 3,625,411 | 12/1971 | Cote | 206/806 |
| 4,201,292 | 5/1980 | Davidson et al. | 206/621 |

*Primary Examiner*—William T. Dixson, Jr.

*Attorney, Agent, or Firm*—Cushman, Darby & Cushman

[57] ABSTRACT

A package including a multiplicity of staple sticks and a box including a thin wall bottom structure and a thin wall top structure movable with respect to the bottom structure between open and closed positions, the improvement which comprises a pair of back-to-back secured panels and flap exteriorly removably attached to the box (1) for positively locking the same in the closed position thereof in response to the movement thereof from the open position into the closed position; (2) for suspending the closed box from a pegboard peg or the like; and (3) for enabling the positive locking and peg suspension functions to be removed from the box in response to the removal of the panels and flap.

15 Claims, 6 Drawing Figures

Fig. 5.
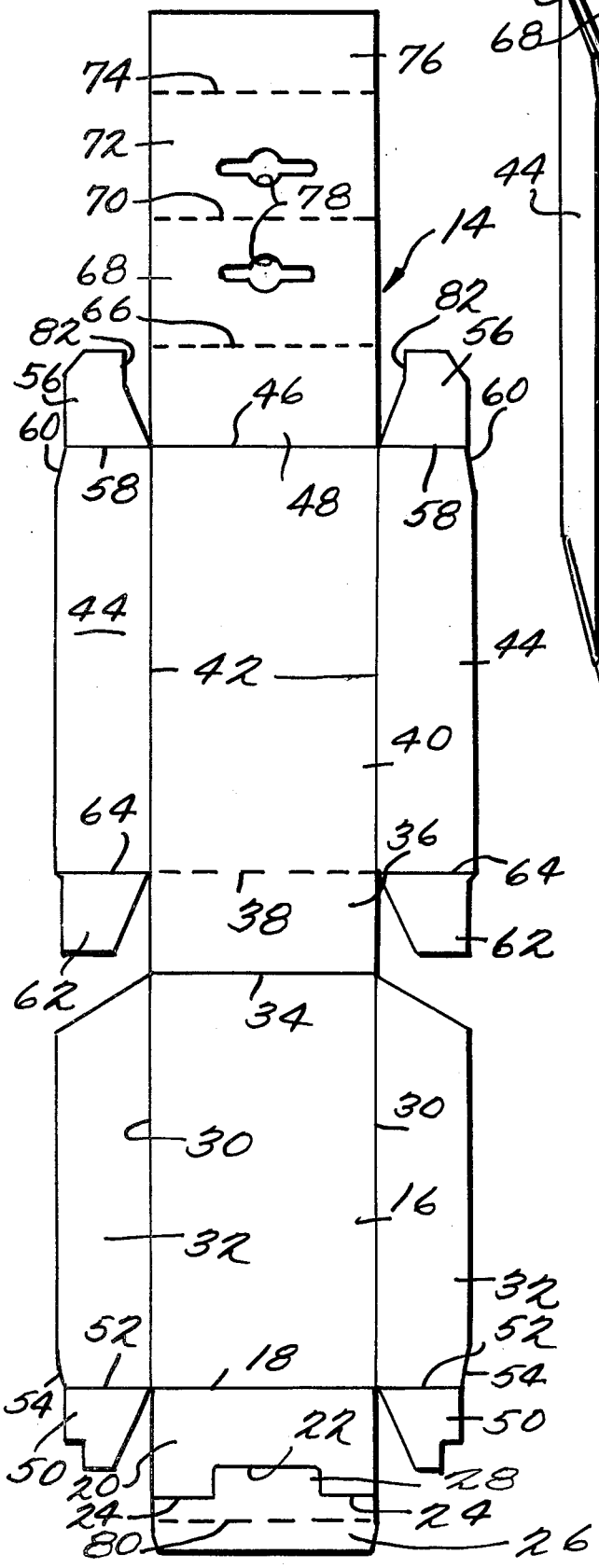
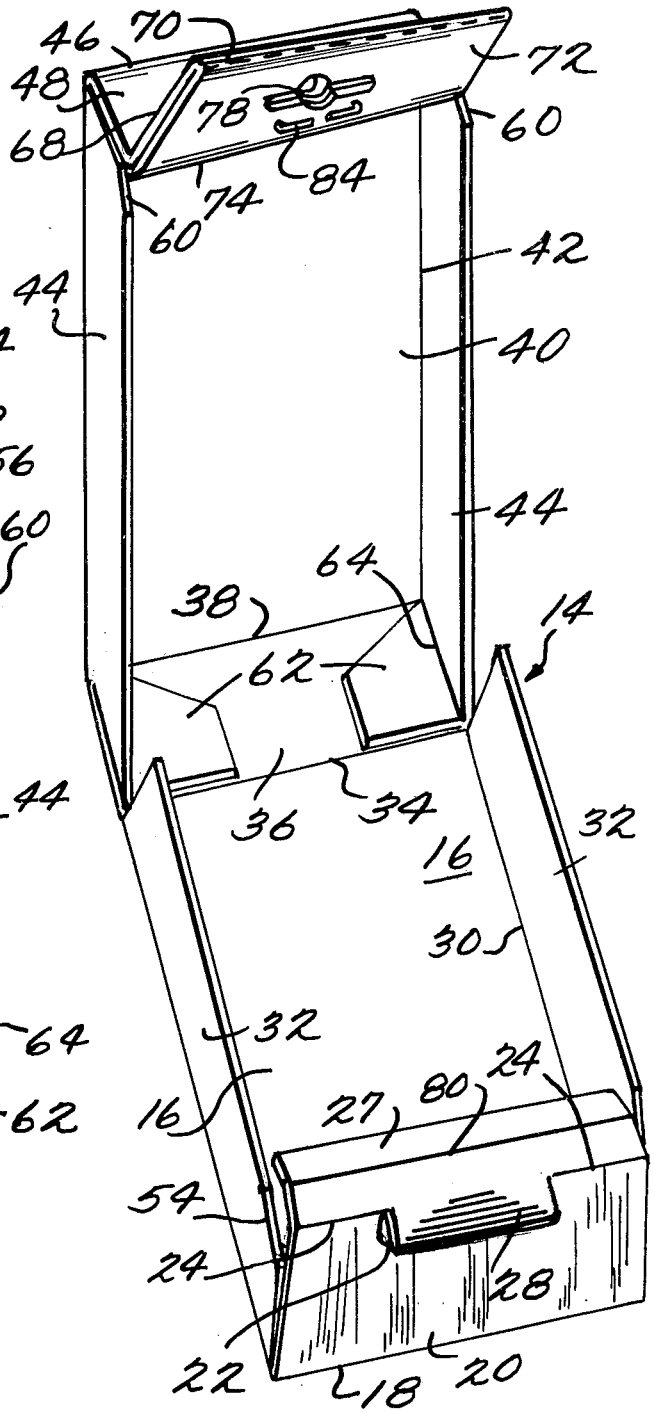
Fig. 6.

STAPLE STICK PACKAGE

This invention relates to packages and more particularly to improvements in small display boxes for containing relatively heavy objects such as staple sticks or the like.

A typical package including a supply of desk staple sticks contained within a box formed from a flat blank cut from a sheet of heavy paper is disclosed in U.S. Pat. No. 2,354,083. The box includes a bottom wall having an upstanding front wall and a pair of upstanding side walls connected at their front ends with the ends of the front walls. The arrangement provides a compartment within which the stapes are initially loaded. The box also includes a top wall having a depending front wall, a pair of depending side walls connected at their front ends with the ends of the depending front wall and a rear wall which depends from the rear of the top wall and is fixed to the rear ends of the side walls. The rear wall has a hinged connection with the rear edge of the bottom wall to enable the box to be moved between an open position and a closed position wherein the upstanding front wall is disposed in inwardly coextensive relation with respect to the depending front wall.

The box as disclosed in the aforesaid patent includes a flap connected with the upper edge of the upstanding front wall which is rearwardly hinged over the upper forward end portion of the staples loaded within the staple loading compartment. In some commercial boxes a releasable locking tab is struck from the upper central portion of the upstanding front wall so that when the flap is rearwardly hinged into its operative position, the locking tab will extend forwardly at the upper edge of the upstanding front wall. Locking tabs of this type are shown in the patented literature as, for example, U.S. Pat. No. 2,839,236. In the commercial boxes mentioned, the edge of the locking tab has a releasable locking action with the upper edges of the side wall tabs which serve to fix the forward edges of the upstanding side walls with the adjacent edges of the upstanding front wall. A releasable locking connection of this type is disclosed in U.S. Pat. No. 2,713,963, dated July 26, 1955.

For purposes of sales display it is a desirable characteristic of a commercial package that it be capable of being mounted or suspended from a rod secured within a pegboard. Elongated tubular boxes which are opened and closed at the ends thereof have been provided with apertured panels integral with one of the walls forming the tubular body of the box for purposes of pegboard display. Boxes of this type are not used as a part of a staple stick package because staple sticks cannot be conveniently loaded and unloaded therefrom. Moreover, staple sticks constitute a relatively heavy load, and consequently fully openable boxes of the type described which are suitable for containing such load cannot be simply provided with a pegboard hanging panel because the weight of the load can inadvertently cause the box to open, thus presenting a highly undesirable situation.

It is an object of the present invention to provide a staple stick package including a box of the type described with removable means for rendering the package capable of pegboard display and of providing a positive locking function capable of preventing an unwanted opening of the box while on display. In accordance with the principles of the present invention, this objective is obtained by forming integrally in the blank cut from a sheet of heavy paper which is assembled to form the box a pair of pegboard suspending panels and a locking flap, one of the panels being hinged to the lower edge of the depending front wall of the box, the other of the panels being hinged to the outer edge of the first panel and the flap being hinged to the outer edge of the second panel. The two panels are generally of the same configuration and are folded together along their common hinge into a generally coextensive fact-to-face abutting relationship so that the hinge connection between the second panel and the locking flap is disposed adjacent to the hinge connection between the first panel and the lower hinge of the depending front wall. Registering apertures are formed in the panels for engaging a pegboard rod when the panels are disposed in a vertical position so that the remainder of the box including the supply of staple sticks therein is suspended from the panels. The flap is folded into a position between the depending front wall and the upstanding front wall and has an upper edge disposed in cooperating relationship with respect to the locking tab provided at the upper end of the upstanding front wall. This cooperative relationship provides a positive retention of the box in its closed position despite any bias toward movement into an open position resulting from the weight of the staples and the manner in which the same are suspended on the pegboard rod. Once the panels have served their purpose of supporting the box for sales display, the panels and flap are removable in a simple fashion by the user so as to remove the aforementioned positive locking retention and to leave the box in a condition of use by the user which is the same as previously provided.

Another object of the present invention is the provision of a box of the type described having an improved removable pegboard hanging and closure locking structure which is simple in construction, effective in operation and economical to manufacture.

These and other objects of the present invention will become more apparent during the course of the following detailed description and appended claims.

The invention may best be understood with reference to the accompanying drawings, wherein an illustrative embodiment is shown.

In the drawings:

FIG. 5 is a plan view of a blank cut from a sheet of heavy paper utilized in forming the box of the present invention; and FIG. 6 is a perspective view of the formed box disposed in an open empty position.

Figure 1:
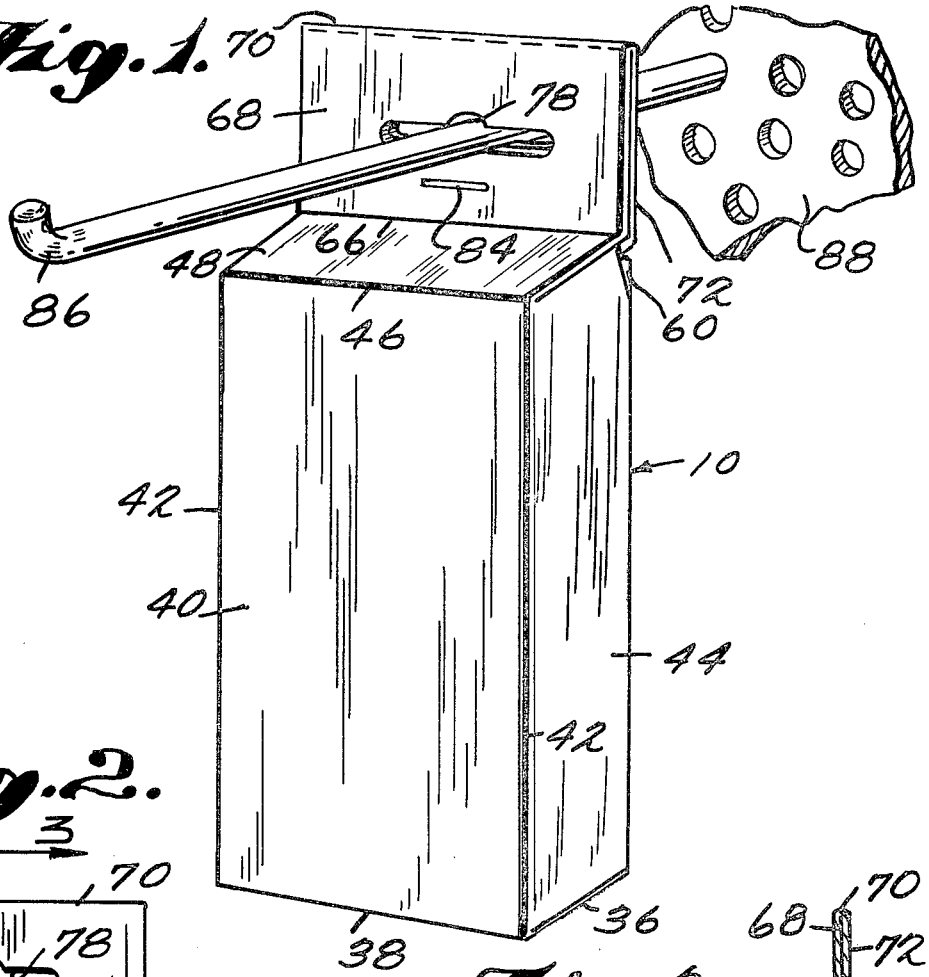
FIG. 1 is a perspective view of a staple stick package embodying the principles of the present invention showing the same suspended from a pegboard rod for sales display.
Figure 2:
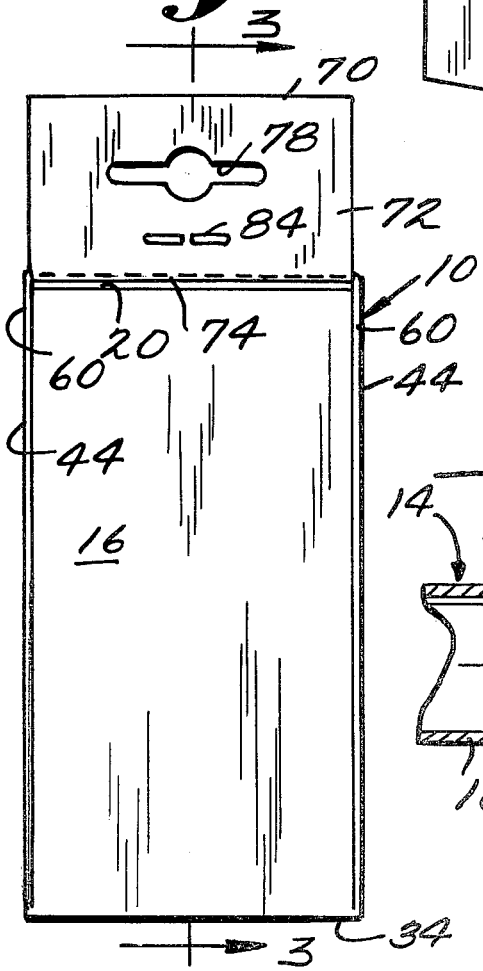
FIG. 2 is a rear elevational view of the package shown in FIG. 1.
Figure 3:
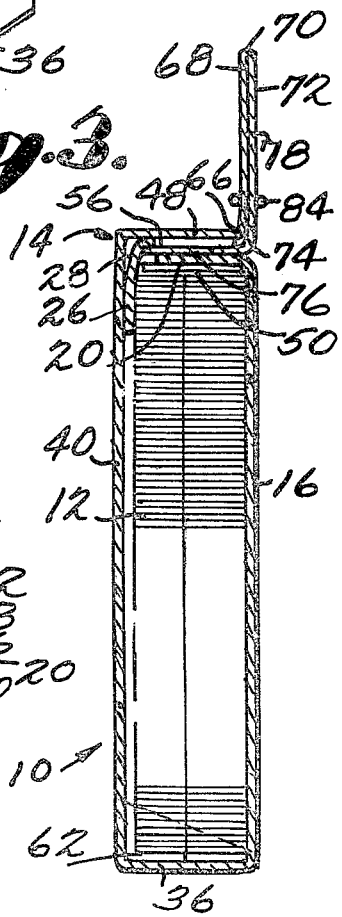
FIG. 3 is a sectional view taken along the line 3—3 of FIG. 2.
Figure 4:
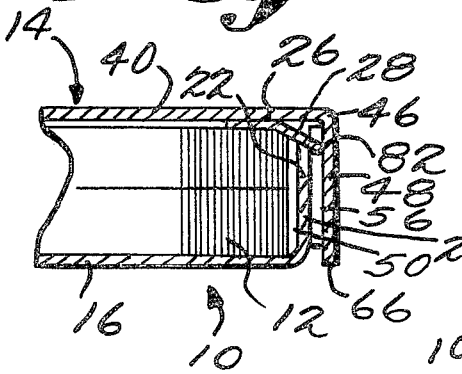
FIG. 4 is a fragmentary sectional view similar to FIG. 3 showing the box in use after the suspension panels and locking tab have been removed.

Referring now more particularly to FIGS. 1-4 of the drawings, there is shown therein a package, generally indicated at 10, which embodies the principles of the present invention. As shown, the package 10 consists essentially of a supply of staple sticks 12 contained within a box, generally indicated at 14, formed from a flat blank cut from a sheet of paper or other similar thin wall material. Preferably the sheet utilized is 0.021" Kraft board coated with white liner. The flat blank which is cut from the sheet to form the box 14 is shown in FIG. 5. This blank is constructed in a manner similar to the blank utilized in forming the box embodied in the staple stick package disclosed in the U.S. Pat. No. 2,354,083 except for the addition of the structural improvements provided by the present invention. Accordingly, the disclosure of the patent is hereby incorporated by reference into the present specification. Insofar as the common apsects of the present blank and the blank of the prior art patent are concerned, it will be noted that the present blank includes a generally rectangular shaped bottom wall 14 which is defined at its front end by a fold line 18, which fold line also serves to define the bottom of a front wall 20.

Formed in the front wall 20 is a U-shaped cut 22. Extending from the free ends of the legs of the cut 22 is a pair of fold lines 24 which defines with the cut the upper edge of the front wall 20. A tab containing wall or flap 26 is provided outwardly of the front wall 20. The central portion of the flap 26 includes a section disposed within the U-shaped cut which provides a locking tab 28. Bottom wall 16 is defined along its sides by a pair of parallel fold lines 30 which, in turn, define the inner edges of a pair of side walls 32. In a similar fashion, the opposite or rearward end of the bottom panel 16 is defined by a fold line 34 which, in turn, defines the lower edge of a rear wall 36, the upper edge of which is defined by a fold line 38 parallel with the fold line 34. Fold line 38 also defines the rearward end of a generally rectangular shaped top wall 40, the sides of which are defined by a pair of parallel fold lines 42. Fold lines 42 are generally aligned with fold lines 30 and also serve to define the upper edges of a pair of side walls 44. The front end of the top wall 40 is defined by a fold line 46 which also defines the upper edge of a front wall 48.

The box blank including the walls thusfar described is cut from the thin wall sheet with an outline configuration which defines the side edges of the front wall 48, the outer edges of the side walls 44, the side edges of the rear wall 36, the outer edges of the side walls 32, the side edges of the front wall 20, and the side edges and free end edge of the flap 26. In addition, the cut peripheral outline of the blank defines a pair of forward bottom side wall assembly tabs 50 which are formed integrally with the associated end edges of the side walls 32 along fold lines 52. It will be noted that the outline configuration is such that the outer edges of the tabs 50 are disposed inwardly of the outer edges of the side walls 32 and the adjacent portions of the side walls 32 are formed with angular outer edge portions 54 which provide a transition for the nonaligned outer edges of the tabs 50 and the associated side walls 32. The outline configuration also provides a pair of similar tabs 56 associated with the ends of the side walls 44 adjacent the front wall 48. Tabs 56 are delineated from the associated side walls 44 by fold lines 58 and angular transitional outer edge surfaces 60 are provided similar to the transition outer edge surfaces 54. A third pair of tabs 62 is also provided by the outline configuration of the box blank, the tabs 62 being interdelineated with respect to the opposite ends of the side walls 44 by fold lines 64.

In the prior art box blank the outer edge of the front wall 48 is defined by the cut outline of the box blank. However, in accordance with the principles of the present invention this outer edge is defined by a series of spaced aligned cuts 66 which also define one edge of a first suspension panel 68. The opposite edge of the first panel 68 is defined by a parallel series of spaced aligned cuts 70 which also define one edge of a second panel 72. The panel 72 is defined along its opposite edge by a similar series of spaced aligned cuts 74 which, in turn, serve to define one edge of a locking flap 76. The end edges of the panels 68 and 72 and the flap 76 are defined by the cut peripheral outline of the blank as is the outer edge of the flap 76.

It will be noted that panels 68 and 72 are of similar configuration and each is provided with an aperture 78. As shown, the apertures 78 are positioned within the panel 68 and 72 in positions symmetrical with respect to the common cut lines 70. As shown, each aperture is in the form of a slot elongated in the direction of extent of the cuts 70 having a circular enlargement at the central portion thereof. As an optional feature the tab 26 may be formed with a line of spaced cuts 80 similar to the line of cuts 66, 70 and 74 for a purpose hereinafter to be more fully described.

The blank as described above including the improvements of the present invention relating to the provision of the panels 68 and 72 and flap 76 is capable of being erected into a box 14 with the use of the erecting machinery previously utilized in erecting the box blanks of the aforesaid patent. The blank is erected and handled in staple stick loading machinery in an erected condition in which the top wall 40 is disposed parallel with and below the bottom wall 16 and the rear wall 36 extends at right angles from the rear fold line of the bottom wall 16 to the rearward end of the top wall 40. It will also be noted that side walls 32 and front wall 20 are folded along fold lines 30 and 18 respectively to extend upwardly from the bottom wall 16, the tabs 50 being folded inwardly along fold lines 52 so that their outer surfaces abuttingly engage the coextensive inner surface of the front wall. The tabs 50 are suitably secured to the front wall, preferably by gluing. Tab containing wall 26 is folded rearwardly along fold lines 24 to cause locking tab 28 to extend forwardly and downwardly. If desired, the wall 26 can be angulated by bending the same along fold line 80.

In a similar fashion, side walls 44 and front wall 48 are folded along fold lines 42 and 46 respectively into an upwardly extending position with respect to the top wall 40. Tabs 62 are folded inwardly along fold lines 64 so that their outwardly facing surfaces are in surface-to-surface engagement with the inwardly facing surface of the rear wall 36. Here again, the tabs 62 are suitably secured to the rear wall 36 in this position preferably by glue. Tabs 56 are likewise folded inwardly along fold lines 58 so that their outwardly facing surfaces are disposed in surface-to-surface contact with the inwardly facing surface of the front wall 48. Again, fixed securement is obtained by glue. In this regard it will be noted that each of the tabs 56 is formed with a straight offset surface 82 which, when the tabs 56 are secured to the front wall 48, are disposed in a common horizontal plane in a position to be engaged by the tab 28 when the box 14 is closed as will be more fully explained hereinafter.

After the box has been loaded with a multiplicity of staple sticks 12, the outer panel 72 and flap 76 are folded along fold lines 70 so that the panels 68 and 72 are in surface-to-surface contact in substantially coextensive relationship with the opening 78 therein in alignment. The panels 68 and 70 are secured in surface-to-surface contact by any suitable means as, for example, a staple 84. Prior to closing the box with a load of staple sticks 12 therein, flap 76 is folded inwardly along fold line 74 so that it lies in substantial surface-to-surface contact with the tabs 56. It can now be seen that when the top structure of the box which includes top wall 40, rear wall 36 and front wall 48 is pivoted from the aforesaid open position about the fold line 34 as a pivot or hinge point, the box will be moved into a closed position in which the lower portion of the front wall 48 of the top structure overlaps the upper portion of the front wall 20 of the bottom structure, the latter being disposed inwardly. In a similar manner, the side walls 32 of the bottom structure inwardly overlap the side walls 44 of the top structure. As the box is moved into its fully closed position, locking tab 28 is deflected downwardly and rearwardly until the top structure is substantially closed at which point the end of the locking tab moves past the end of the flap 76 so as to provide for the positive retention of the box in a closed position. Thus, the flap 76 serves to lock the package into the positively retained condition in response to the movement of the box into its closed position.

FIG. 1 illustrates the position assumed by the package 10 when mounted on a peg 86 of a conventional pegboard 88. The peg 86 extends into the aligned openings 78 when the secured together panels 68 and 72 are disposed vertically. In this condition the main body of the package is suspended therebelow. When it is desired to use the package, as for example, to obtain access to a staple stick for purposes of replenishing a desk stapler or the like, the user grasps the secured together panels 68 and 72 and manually separates the same along with the flap 76 from the remainder of the package by moving the same downwardly along the cut lines 66. When panel 68 is finally separated along the cut line 66 from the front wall 48, panel 72 secured therewith and flap 76 connected to the panel 72 along the integral Kraft board between the cuts 74 are then automatically removed from the remainder of the package. The removal of the flap from a position of locking cooperation with the locking tab 28 leaves the locking tab in a releasable locking position with respect to tab surfaces 82, as clearly shown in FIG. 4.

It will be understood that the terms top, bottom, up, down and the like are used therein in a comparative sense rather than an absolute sense. That is, while these directional words are used to accurately describe the intended orientation of the package 10 when used normally, it will be understood that the structure and function of the package is not altered by altering the intended orientation thereof. Hence, these directional words are used herein in the sense of directional capability rather than directional intention.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a package including a multiplicity of U-shaped staple sticks and a thin wall box containing said staple sticks, said box comprising a bottom wall having an upstanding front wall and a pair of upstanding side walls connected at their front ends with the ends of said upstanding front wall, a top wall having a depending front wall and a pair of depending side walls connected at their front ends with the ends of said depending front wall, a rear wall hinged to the rear of both said top and said bottom walls respectively, one pair of said side walls having their rear ends fixed to the ends of said rear wall, said box being disposed in a closed position encompassing said staple sticks with an upper portion of said upstanding front wall lapped inwardly with respect to a lower portion of said depending front wall, the improvement which comprises said upstanding front wall having a locking tab extending forwardly from the lapped portion thereof, said depending front wall having a first panel hinged to a lower edge thereof, a second panel hinged to an outer edge of said first panel and a flap hinged to an outer end of said second panel, said first and second panels being folded about the associated hinge and secured in abutting relation with respect to one another so as to dispose the hinged connection between said second panel and said flap in a position adjacent the hinge connection between said first panel and the lower edge of said depending front wall, said flap extending upwardly between the lapped portions of said front walls in cooperative relation with respect to said locking tab, said panels having registering openings extending therethrough operable to engage a pegboard peg or the like with said panels disposed generally vertically and the remainder of said box suspended therebelow with the cooperative association between said flap and said locking tab positively retaining the box in its closed position, said panels and flap being removable from the lower edge of said front panel to enable said box to be moved from its closed position into an open position without the aforesaid positive retention provided by the cooperative relation between said flap and said locking tab.

2. The improvement as defined in claim 1 wherein said locking tab is struck from the upper end portion of said upstanding front wall and extends forwardly from the central portion of a tab containing wall, said tab containing wall having opposite side portions which are hinged to the upper edge of said upstanding front wall.

3. The improvement as defined in claim 2 wherein said tab containing wall includes a fold line extending between the side edges thereof.

4. The improvement as defined in claim 1 wherein said first and second panels are of generally similar rectangular configuration.

5. The improvement as defined in claim 4 wherein said flap is of generally rectangular configuration.

6. The improvement as defined in claim 1, 2, 3, 4 or 5 wherein the hinge connection between said first panel and the lower edge of said depending front wall is formed by the integral thin wall material remaining after a series of spaced longitudinally aligned cuts are made therein, said cuts facilitating removal of said panels and flap from said depending front wall.

7. The improvement as defined in claim 6 wherein the hinge connections of said second panel with said first panel and with said flap are formed by the integral thin wall material remaining after a series of spaced longitudinal aligned cuts are made therein.

8. In a box of the type including a thin wall bottom structure and a thin wall top structure movable with respect to one another between open and closed positions, said bottom structure including a bottom wall having an upstanding front wall and a pair of upstanding side walls connected at their front ends with the ends of said front wall, said top structure including a top wall having a depending front wall and a pair of depending side walls connected at their front ends with the ends of said depending front wall, said box when in said closed position having an upper portion of said upstanding front wall lapped inwardly with respect to a lower portion of said depending front wall, the improvement which comprises said upstanding front wall having a locking tab extending forwardly from the lapped portion thereof, said depending front wall having a first panel hinged to a lower edge thereof, a second panel hinged to an outer edge of said first panel and a flap hinged to an outer edge of said second panel, said first and second panels being folded about the associated hinge and secured in abutting relation with respect to one another so as to dispose the hinge between said second panel and said flap in a position adjacent the hinge between said first panel and the lower edge of said depending front wall, said flap extending upwardly between the lapped portions of said front walls in cooperative relation with respect to said locking tab, said panels having registering openings extending therethrough operable to engage a pegboard peg or the like with said panels disposed generally vertically, the remainder of said box suspended therebelow, and the cooperative relationship between said flap and said locking tab positively retaining the box in its closed position, said panels and flap being removable from the lower edge of said depending front wall to enable said box to be moved from its closed position into an open position without the aforesaid positive retention provided by the cooperative association between said flap and said locking tab.

9. The improvement as defined in claim 8 wherein said locking tab is struck from the upper end portion of said upstanding front wall and extends forwardly from the central portion of a tab containing wall, said tab containing wall having opposite side portions which are hinged to the upper edge of said upstanding front wall.

10. The improvement as defined in claim 9 wherein said tab containing wall includes a fold line extending between the side edges thereof.

11. The improvement as defined in claim 8 wherein said first and second panels are of generally similar rectangular configuration.

12. The improvement as defined in claim 11 wherein said flap is of generally rectangular configuration.

13. The improvement as defined in claim 8, 9, 10, 11 or 12 wherein the hinge connection between said first panel and the lower edge of said depending front wall is formed by the integral thin wall material remaining after a series of spaced longitudinally aligned cuts are made therein, said cuts facilitating removal of said panels and flap from said depending front wall.

14. The improvement as defined in claim 13 wherein the hinge connections of said second panel with said first panel and with said flap are formed by the integral thin wall material remaining after a series of spaced longitudinal aligned cuts are made therein.

15. In a box including a thin wall bottom structure and a thin wall top structure movable with respect to said bottom structure between open and closed positions, the improvement which comprises means exteriorly removably attached to said box (1) having a part cooperatively tab locking the same in said closed position in response to the movement thereof from said open position into said closed position; (2) an opening therein for suspending the closed box from a pegboard peg or the like; and (3) having a cut line for enabling the cooperative tab locking and peg suspension means to be removed from said box.

* * * * *